United States Patent [19]

Duncan

[11] Patent Number: 4,831,684

[45] Date of Patent: May 23, 1989

[54] CLEANING VEHICLES

[75] Inventor: Ian J. Duncan, Cambridge, United Kingdom

[73] Assignee: Morningfield Limited, Cambs, Great Britain

[21] Appl. No.: 47,915

[22] PCT Filed: Aug. 27, 1986

[86] PCT No.: PCT/GB86/00508

§ 371 Date: Apr. 21, 1987

§ 102(e) Date: Apr. 21, 1987

[87] PCT Pub. No.: WO87/01404

PCT Pub. Date: Mar. 12, 1987

[30] Foreign Application Priority Data

Aug. 31, 1985 [GB] United Kingdom ..... 8521708
Nov. 20, 1985 [GB] United Kingdom ..... 8528588

[51] Int. Cl.[4] ..... E01H 1/05

[52] U.S. Cl. ..... 15/340.1; 15/87; 15/347; 15/368; 15/415 R

[58] Field of Search ..... 15/87, 340, 368, 347, 15/415 R

[56] References Cited

U.S. PATENT DOCUMENTS 1,546,071 7/1925 Harris ..... 15/87
3,436,788 4/1969 Tamny ..... 15/340
4,368,554 1/1983 Mealing et al. ..... 15/383 X
4,395,794 8/1983 Duncan ..... 15/340
4,490,874 1/1985 Duncan ..... 15/87
4,554,701 11/1985 Van Raaij ..... 15/340
4,580,312 4/1986 Van Raaij ..... 15/340 X

FOREIGN PATENT DOCUMENTS 1012627 7/1957 German Democratic Rep. ... 15/340
1217424 5/1966 German Democratic Rep. ... 15/340
7114815 5/1973 Netherlands .
787549 12/1980 U.S.S.R. ..... 15/87
1046341 10/1966 United Kingdom ..... 15/340

*Primary Examiner*—Chris K. Moore

[57] ABSTRACT

A self-propelled sweeper vehicle (10) has front steerable wheels (16) mounted on a centrally pivoted axle assembly (28) which also carries the nozzle (30) and brush gear (24) whereby these assemblies are steered in unison with the vehicle. The nozzle front edge (106) is convex and promotes non-turbulent air intake. The nozzle is formed as a hollow rotationally moulded structure of a plastics material having inherent structural strength and stiffness. The brush gear (24) is mounted on linkages comprising inner and outer portions (200, 202) pivotally connected for folding movement to resiliently yield under impact. The brush covers (260) are formed as hollow plastics mouldings and part of the brush support structure.

21 Claims, 9 Drawing Sheets

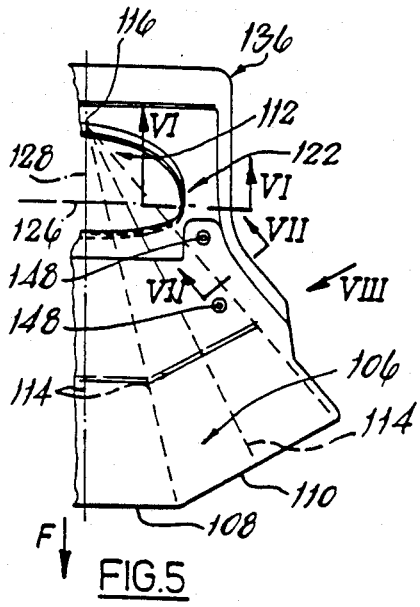
FIG.5
FIG.9
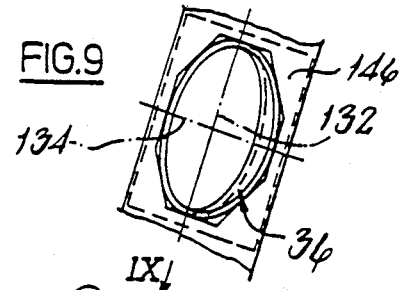
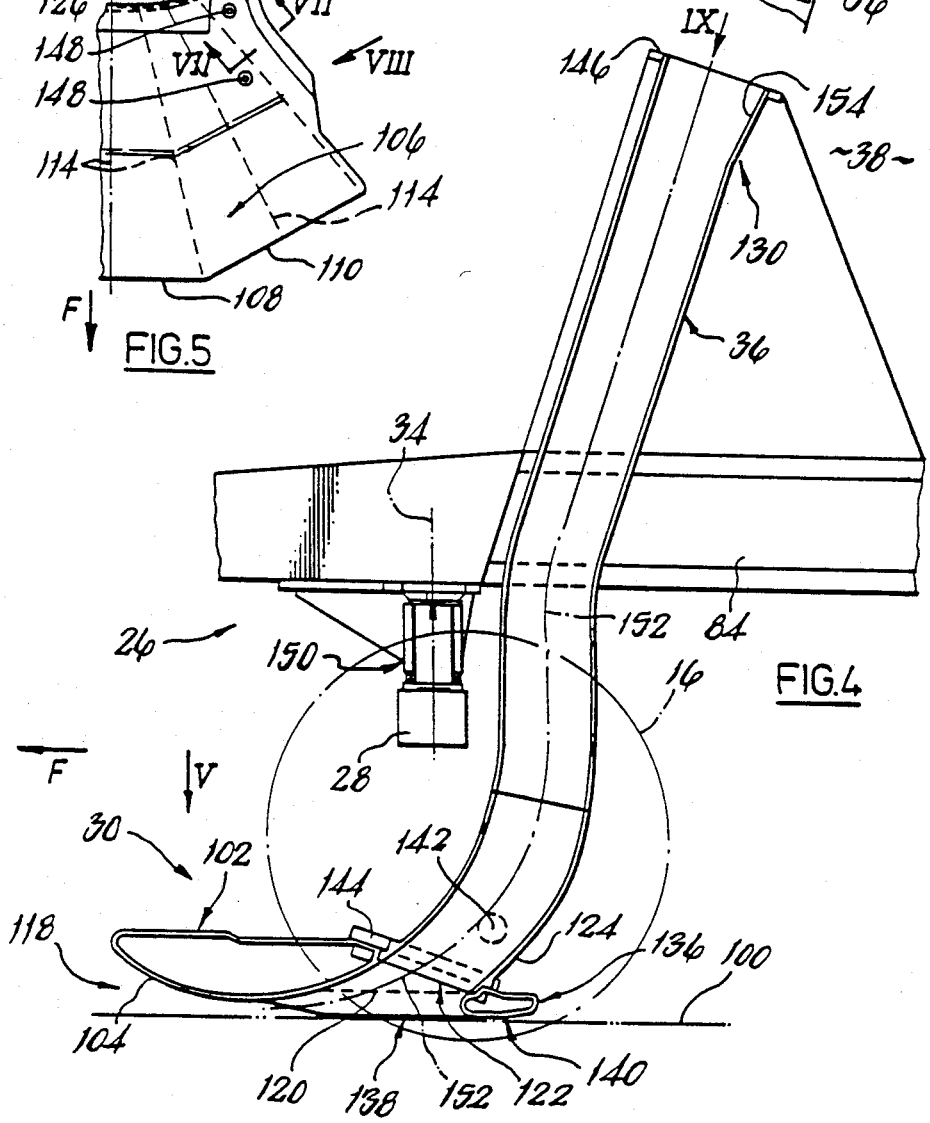
FIG.4

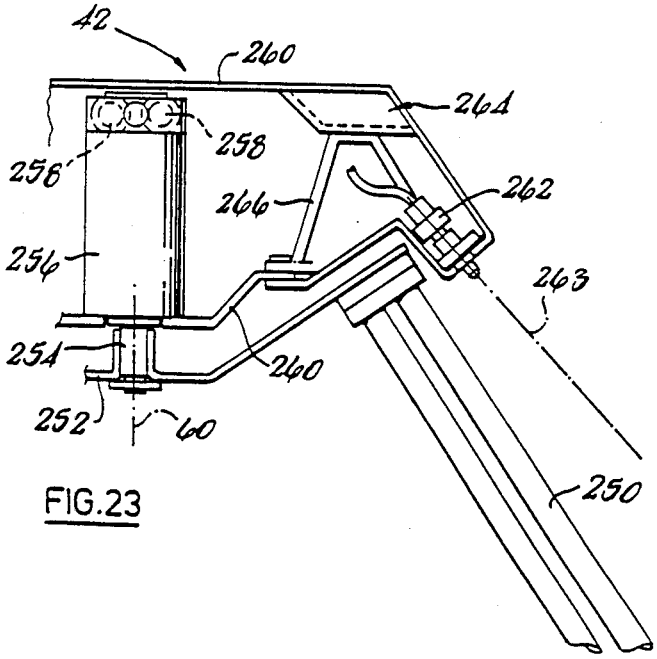
FIG.23
FIG.16
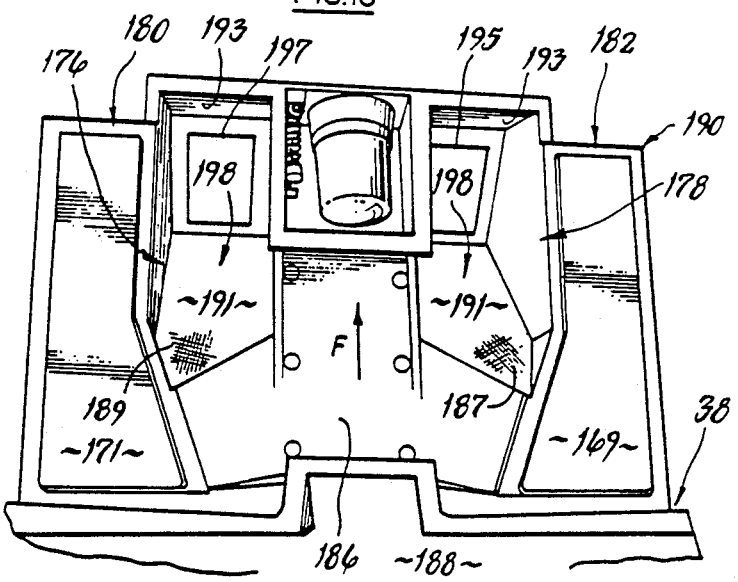

CLEANING VEHICLES

This invention relates to cleaning vehicles comprising matter removal means such as brush gear or suction gear, or both. An example of such a vehicle is a self-propelled cleaning vehicle for cleaning roads and/or runways and/or pavements and/or carrying out industrial cleaning and sweeping, the vehicle having suction gear including a suction nozzle with brush gear in the form of side brushes rotating about upwardly extending axes and serving to sweep matter laterally inwardly into the bath of the nozzle.

Presently available cleaning vehicles require improvement in respect of the brush gear and suction gear and associated assemblies, particularly their structure, mounting and control. As regards the suction gear, improvements are also needed in respect of the ducts and other assemblies, particularly their structure and arrangement having regard to air flow, power consumption and related factors.

An object of the invention is to provide cleaning vehicles, and other apparatus, providing improvements in one or more of these respects, or generally.

According to the invention there is provided a cleaning vehicle as defined in the accompanying claims. The invention also provides other apparatus as defined in the claims.

The invention also provides cleaning vehicles and other apparatus not limited by all features of any claim hereof and comprising any novel feature, or novel combination of features disclosed herein.

Embodiments of the invention will now be described by way of example with reference to the accompanying drawings in which:

FIG. 4 shows, on a larger scale, a vertical section in the front/rear direction through the suction nozzle and associated structures;

FIG. 5 shows a plan view of the left hand half of the nozzle of FIG. 4 as viewed in the direction of arrow V in FIG. 4;

FIG. 9 shows an end view of the suction duct of FIG. 4, the direction of viewing being indicated by arrow IX in FIG. 4;

FIG. 16 shows a rear view of part of the vacuum tank assembly of FIG. 2, the direction of viewing being indicated by arrow XVI in FIG. 2;

FIG. 22 shows a section through a cross-member linking the side frames of the cab, the section being taken in the direction indicated by arrows XXII—XXII in FIG. 1; and FIG. 23 shows a vertical section through a modified brush head assembly.

STEERING GEAR

Figure 1:
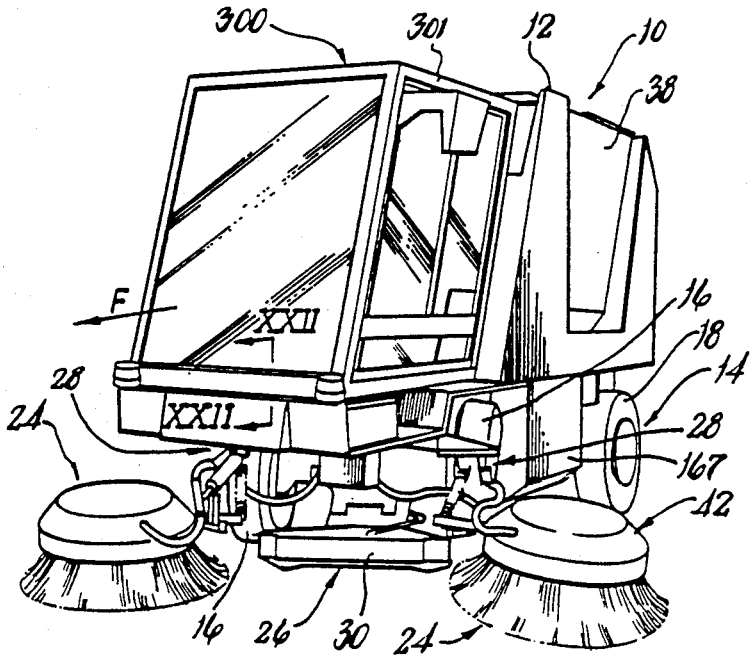
FIG. 1 shows a perspective view of a cleaning vehicle as seen from the front and to one side, with the brush gear and suction nozzle turned for a left hand corner.

In the case of cleaning vehicles comprising matter removal means such as brush gear or suction gear or both, problems arise with respect to the steering arrangements for the vehicle. There are difficulties in mounting the brush gear and/or the inlet or nozzle of the suction gear in order to achieve the most effective cleaning action. This is particularly so when cleaning around structures such as cars or street furniture requiring the vehicle to adopt a turning circle of the smallest radius possible. Usually cleaning vehicles of this kind are front steered and this in itself leads to problems in the location of the nozzle with respect to the front wheels. The geometry of the wheel movement in itself means that the nozzle cannot be located directly between and closely adjacent to the steered wheels as would be desirable, since fouling of the nozzle would inevitably occur on tight corners. Moreover, there is a need to provide a more effective mounting of the brush gear and/or the nozzle with respect to the vehicle as a whole, than is provided by current systems, particularly those in which the nozzle assembly is mounted on castor wheels or is mounted on skids.

As shown in the drawings, a cleaning vehicle 10 comprises a vehicle body 12 mounted on ground wheels 14 including front steerable wheels 16 and driven rear wheels 18. Control means 20 in the form of a steering wheel and associated steering gear is provided to control steerable wheels 16 in the usual way. Matter removal means 22 comprising brush gear 24 and suction gear 26 is mounted on vehicle body 12 and is connected to steerable wheels 16 so as to turn relative to the vehicle body as the vehicle is steered. In this embodiment, the brush gear and the suction gear are both mounted on support means 28 which is itself mounted for turning movement relative to the vehicle body. The support means also carries the steerable wheels 16 so that the entire assembly moves in unison. The matter inlet means or nozzle 30 is located between steerable wheels 16 and closely adjacent to their inner surfaces. The support means 28 has a generally centrally located pivot 32 whereby the assembly can turn about a generally upwardly extending axis 34. In this way the brush gear and nozzle and the steerable wheels turn as a single assembly, whereby their relative positions are unchanged during steering movements of the vehicle. A suction duct 36 serving to connect nozzle 30 with a chamber or vacuum tank 38 of vehicle 10 is arranged with the lengthwise axis of duct 36 located close to pivot axis 34, the degree of proximity being such that as the steering assembly turns during vehicle manoeuvres, the movement of suction duct 36 around axis 34 while joined at a fixed location at its upper end to vacuum tank 38 produces flexure of duct 36 which can be resiliently accommodated by its flexibility. In a modification, not illustrated, duct 36 extends through an annular bearing defining steering axis 34.

Figure 3:
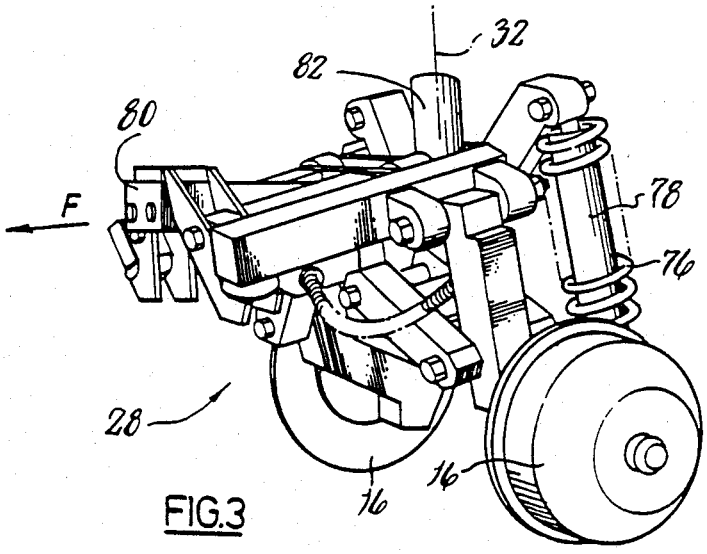
FIG. 3 shows a perspective view from the rear and one side of a suspension assembly forming a front steering unit for the vehicle and a support for the suction nozzle and brush gear.

FIG. 3 shows the general arrangement of support means 28 which is in the form of a unitary front axle unit providing a resilient suspension for the steerable wheels 16 by virtue of coiled compression springs 76 and associated shock absorbers 78. The suspension assembly for each of the front wheels is based upon conventional automotive designs, but is incorporated into the unitary front axle assembly which comprises a main structural frame 80 from which a substantial upstanding steering bearing 82 projects to be received in bearing housing 150 ( see FIG. 4 ) projecting down from the vehicle main frame 84 of vehicle 10. The assembly 28 is connected to the driver's steering wheel and steering gear box for pivotal movement about steering axis 32. Fixed to main frame 80 and moving in unison with it are mounting plates 86 to which brush gear 24 is secured, as described in detail above.

Figure 10:
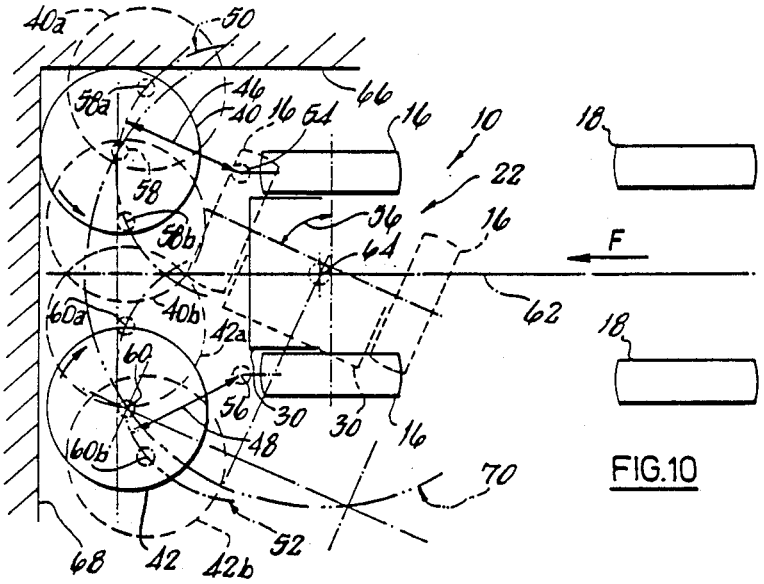
FIGS. 10 and 11 show, diagrammatically, plan views of the vehicle 10 during sweeping operations into a right-angled corner, and when executing a left-hand turn, respectively.

FIG. 10 illustrates vehicle 10 sweeping out a rectangular corner in a manner which would be impossible for most cleaning vehicles of this kind. Side sweep brushes 40 and 42 of brush gear 24 are carried on brush mountings 44, 45 comprising swingable support arms 46, 48 for movement in arcs 50, 52 about the axes 54, 56 at the inner ends of the arms, under the control of the driver.

FIG. 10 shows the normal straight ahead positions of the brushes 40, 42, in full lines, and the adjusted positions in dotted lines identified as 40a, 40*b* and 42*a*, 42*b*. The brush axes are likewise shown at 58*a*, 58*b* and 60*a*, 60*b*. In FIG. 10, the centre line 62 of vehicle 10 extends through the steering axis 32. The maximum angle 64 between the front wheel axes in their straight ahead position and their fully turned position shown in FIG. 1, in this embodiment is 66 degrees.

Figure 11:
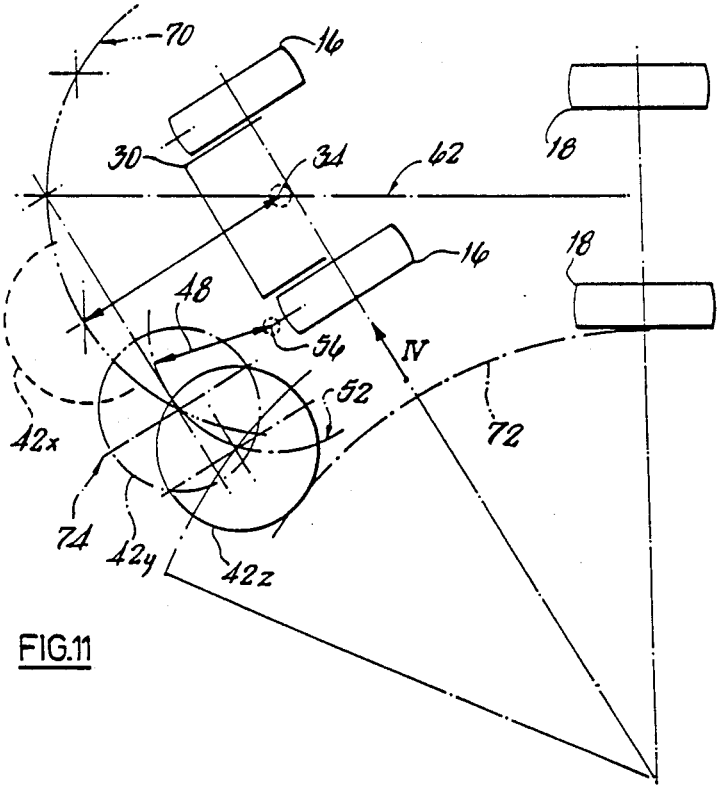

FIG. 10 clearly shows how, as wheels 16 are turned about axis 34, the brushes 40, 42 can sweep into the corner defined by building walls 66, 68 so that a high proportion of this awkward right-angled zone is thereby swept, by judicious use of the steering and brush swinging controls (described below. During the turning movement, the brushes move along an arc 70 centred on steering axis 34, defining their nominal unadjusted positions. In FIG. 2, corresponding items are numbered as in FIG. 1 and the vehicle is shown being steered around a left-hand bend defined by a curb 72. The problem in sweeping such a bend is illustrated in FIG. 11 by the position of the left-hand brush 42 which is shown in its unadjusted ( straight ahead ) position at 42X. Reference 42Y shows the brush's position after turning the steering about axis 34. Reference 42Z shows the corresponding position of the brush after the operator has actuated the swing control to swing the brush inwards about axis 56 on its support arm 48, whereby the brush reaches curb 72 and thereby has a sweep line 74 directing material into the zone of nozzle 30. It will be appreciated that due to the unitary mounting of the brushes and the nozzle, their relative positions during steering manoeuvres ( other than movement of the brushes about their brush pivot axes ) are the same as if the vehicle were proceeding straight forwards, whereby sweeping efficiency is maintained at all times. The same unitary mounting of the steerable wheels and the matter removal gear also enables very tight turning circles to be achieved.

Among other modifications which could be made in the above embodiment without departing from the scope of the invention are the following. Firstly, for certain applications the vehicle could have rear steerable wheels, or indeed a single steerable wheel. Secondly, the support means for the cleaning gear, whether brush gear or suction gear such as a nozzle, need not necessarily be in the form of a centre-steer or fifth wheel axle assembly. For example, it is envisaged that the cleaning gear can be mounted on a pivoted structure connected to a hybrid pivotal ackermann type steering system providing differential angular movement for the steered wheels about individual king pin axes. The support structure may have its own upstanding pivotal axis and be connected to the steered wheels by hydraulic or mechanical means permitting selective disconnection ( effected when not sweeping ) and providing for greater or equal or lesser angular movement of the cleaning gear than the steered wheels. Naturally, the invention is applicable to other cleaning machines such as scrubbing machines and those employing a brush-type material lift system in place of a suction system.

SUCTION GEAR—NOZZLE AND SUCTION DUCT

The suction gear 26 of vehicle 10 comprises nozzle 30 connected via suction duct 36 to a vacuum tank or chamber to receive matter removed in the cleaning operation. A fan assembly draws the air and entrained matter into the tank and discharges its pressure side to atmosphere.

Limitations of existing nozzle and suction duct assemblies include inadequate air flow efficiency, the production of turbulence, consequential high power consumption in the fan assembly, relatively high manufacturing cost, insufficient ability to accommodate large foreign bodies such as soft drink cans, and inadequate resistance to damage upon impact with street furniture and the like.

As shown in FIGS. 4 to 9 nozzle 30, constituting matter inlet means, is positionable in close proximity to a surface 100 to be cleaned. The nozzle comprises a moulding of a polymeric materialforming a hollow chamber 102 of which the lower surface 104 provides a smoothly profiled upper surface for the front portion of the nozzle. Upper surface 104 of chamber 102 constitutes an air guide surface. All the internal surfaces of nozzle 30 are smoothly profiled to promote efficient air flow. As shown in FIG. 5 the front portion 106 of nozzle 30 has a generally convex shape as seen in plan view. This shape is made up from a central linear section 108 and side sections 110. The result of this convex shape is that the length of the air path over air guide surface 104 between the front edge 108, 110 of the nozzle and the rear region 112 of the nozzle is of approximately equal length across the full operating width of the nozzle. This is illustrated by the radii 114 shown in FIG. 5 and radiating from point 116.

The throat 118 defined by nozzle 30 and into which air and matter are drawn is defined by air guide surface 104 at the top and by the swept surface 100 below. The lateral extend of the throat is defined by side walls 120 diverging along radii 114. The throat 118 converges to a nozzle outlet 122 to which is joined the lower end 124 of suction duct 36. As can be seen in FIG. 5 nozzle outlet 122 and hence lower end 124 of duct 36 are of non-circular cross-sectional profile, being generally rounded and having major and minor axes 126, 128 respectively, the latter coinciding with the central radius 114 in FIG. 5. Major axis 126 extends generally transverse to the direction F of normal forward motion of vehicle 10. It can be seen from FIG. 9 that the upper end 130 of duct 36 has a similar cross-sectional profile to its lower end 122, being generally rounded and having a major axis 132 and a minor axis 134. Both profiles are thus generally oval or elliptical, thereby serving to complement the relatively wide intake width of throat 118 defined by side walls 120, and enabling relatively large objects such as soft drink cans to pass up the duct 36 without jamming.

As shown in FIGS. 4 to 7 the structure of nozzle 30 is substantially entirely a hollow body. Chamber 102 forms the front portion thereof. This is integral with the side walls 120. These latter continue around the rear periphery 136 of the nozzle. As can be seen from FIGS. 4, 6 and 7, side walls 120 and the rear peripheral portion 136 have a double-skinned structure including a generally flat ground-facing surface 138. At the rear 136 of the nozzle this lower surface 140 is radiused slightly to accommodate raising and lowering of the nozzle about a lateral axis 142, under the control of the driver to admit large objects such as soft drink cans. Hollow chamber 102 and throat side walls 120 and rear portion 136 of the nozzle thus form a single hollow structure having considerable structural strength and impact resistance. These structures are formed of a very durable plastics material. The unitary nature of the hollow structure of nozzle 36 gives the latter great structural integrity. The resilient characteristics of the plastcis material add to this significant impact resistance and durability. Moreover, the smoothly curved lower profile of rear portion 136 of the nozzle complements the corresponding smooth periphery of the forward and internal portions of the nozzle whereby the relatively small proportion of air entering at the rear of the nozzle does not cause turbulence or otherwise interfere with the smooth air flow.

Nozzle 30 is formed by a rotational or blow moulding technique. This enables the hollow structure to be formed in a cost effective manner. Duct 36 is similarly formed. Its lower portion 124 is detachably fixed to the nozzle. Structural integrity is promoted by a flange 144 formed at the bottom of the duct. The duct may be formed in one or more lengths. Its upper end 130 is mounted on a support 146 and is thus fixed. Nozzle 30 turns with front wheels 16 about steering axis 34. Thus duct 36 must accommodate a degree of deflection as steering occurs. Its middle portion moves in an arc around axis 34. The nozzle is mounted on support means 28 by fasteners secured to fixing points 148 on the nozzle. The support structure ( not shown ) connecting nozzle 30 to steering axis bearing 150 provides for up and down pivoting of the nozzle about axis 142 under driver control. Such movement is accommodated by flexure of duct 36. For certain applications, it may be preferred to manufacture duct 36 from a resilient material such as rubber, suitably reinforced.

In use, the smoothly merging profiles of the nozzle and the suction duct promote efficient air flow along a principal flow path indicted by line 152 in FIG. 4. The air follows a curved path whereby frictional losses and turbulence are minimized. The generally rectangular oblong cross-sectional shape of throat 118 smoothly merges into the bottom end of suction duct 36, thereby contributing to minimizing air flow efficiency losses. This effect is enhanced by provision of a flared portion 154 of duct 36 at its upper end 130 where it opens into vacuum tank 38. This flared portion of the suction duct acts as a diffuser in which the cross-sectional area of the tube is increased. The kinetic energy of the entrained matter carries it on, but the air is slowed down. In this way kinetic energy of the air is recovered. For example, with a 10% reduction in air velocity, a 20% reduction in power consumption may be achieved.

The provision of the convex front edge of the nozzle has the significance that it provides substantially constant path lengths for air entering the nozzle, between the nozzle front edge and the bottom of the suction duct, at all positions across the width of the nozzle. This greatly facilitates non-turbulent air intake. The conventional arrangement with a linear transverse nozzle front edge leads to greatly varying lengths of air flow path through the nozzle, whereby the acceleration effect of the nozzle has varying effects on the air according to its intake location. Hence, different final air speeds are produced with consequential turbulence.

Among modifications which could be made in this embodiment without departing from the scope of the invention are the following. Firstly, the front edge 108 of nozzle 30 could be formed with a curved profile instead of the approximation thereto provided by the straight edges in the above embodiment. Considerable variation of the form of the hollow structure of the nozzle may be needed for particular nozzle applications. It may be possible to provide a satisfactory nozzle having two or more closed hollow chambers providing structural members thereof and not forming a single continuous chamber. Although the hollow chamber is generally closed, some opening therein for particular applications may be tolerated without significantly affecting structural integrity. Suitable polymeric materials for manufacture of the nozzle and duct assembly include the following, whether with or without suitable fillers: linear medium density polyethylene (LMDPE), linear high density polyethylene (LHDPE) ultra high density polyethylene (UHDPE), cross-linked high density polyethylene, Du Pont Hytrel, E.V.A., and others. Suction duct 36 is oval in section throughout its length. It could blend into a larger section cylindrical duct.

SUCTION GEAR—FAN ASSEMBLY AND VACUUM TANK

Previously proposed suction cleaning vehicles employ fans driven by mechanical or hydraulic means from an internal combustion engine. Where an auxiliary engine is provided to drive the fan, substantial energy losses can be accommodated, but this is not the case with the compact vehicle described below in which a single power plant must drive all systems of the vehicle and with maximum efficiency. Therefore, in such a vehicle, the typical fan operating efficiency of 40% or less for conversion of power imput to air pressure and flow cannot be accepted. Other unsatisfactory aspects of presently available sweeper vehicles include high noise output from the pressure side of the fan and from the entry to the nozzle, and the significant space taken up by air transfer ducts and chambers and the consequential effect on overall vehicle size.

As shown in FIGS. 2 and 14 to 16 of the drawings, vehicle 10 comprises a rear engine 160 driving hydraulic pumps delivering fluid to hydraulic motors driving rear wheels 18 and corresponding hydraulic motors 162 driving respective fan assemblies 164 and 166. The fans constitute suction means communicating on their suction sides through suction ducts 168 and 170 with vacuum tank 38 whereby air and matter are drawn via the nozzle suction duct 36, into the tank. The pressure side of each fan discharges air to atmosphere through respective diffuser ducts 172 and 174 which have duct walls which diverge towards the outlet end thereof. The diffuser ducts discharge the air from the pressure side of the fans through respective plenum chambers 176 and 178 provided on an upper portion of tank 38 at the front end thereof. The plenum chambers are formed as an integral moulded assembly with two other generally wedge-shaped chambers, namely suction chambers 180, 182. Between plenum chambers 176 and 178 is a central channel 184 having a generally horizontal top surface 186 forming a forward continuation of the flat rear surface 188 of vacuum tank 38 which, as shown in FIG. 2, pivots to an open discharge position when tank 38 is raised for emptying. The various chambers and channels are indicated diagrammatically in FIG. 14 and are formed in a unitary plastics moulding 190 secured into the top of vacuum tank 38. Suction ducts 168 and 170 open through suction chambers 180 and 182 and through inclined wire mesh screens 192 into vacuum tank 38. Thus the relatively large rectangular screens constitute the means through which the tank is evacuated. The arrows 194 indicate air passing through the screens and into the suction ducts. Arrow 196 indicates air and entrained matter leaving the discharge end 130 of the nozzle suction tube 36. Arrows 198 show air discharged from the pressure side of fans 164 and 166. the upper ends of diffuser ducts 172 and 174 mate with inlet openings 197, 195 formed in plenum chambers 176 and 178. The front and rear walls 193, 191 of the plenum chambers diverge, whereby the fore/aft width of the chambers progressively increases in the discharge direction. A generally horizontal screen 189, 187 is provided at the top of each chamber 176, 178 and closes the top opening thereof, extending between the edges defining the opening. The screen comprises wire mesh or expanded metal material and serves further to decelerate air discharged. In use, the plenum chambers represent a considerable enlargement of the cross-sectional area of the diffuser ducts and serve to decelerate the air discharged into them, and this effect is increased by the top screens.

Figure 15:
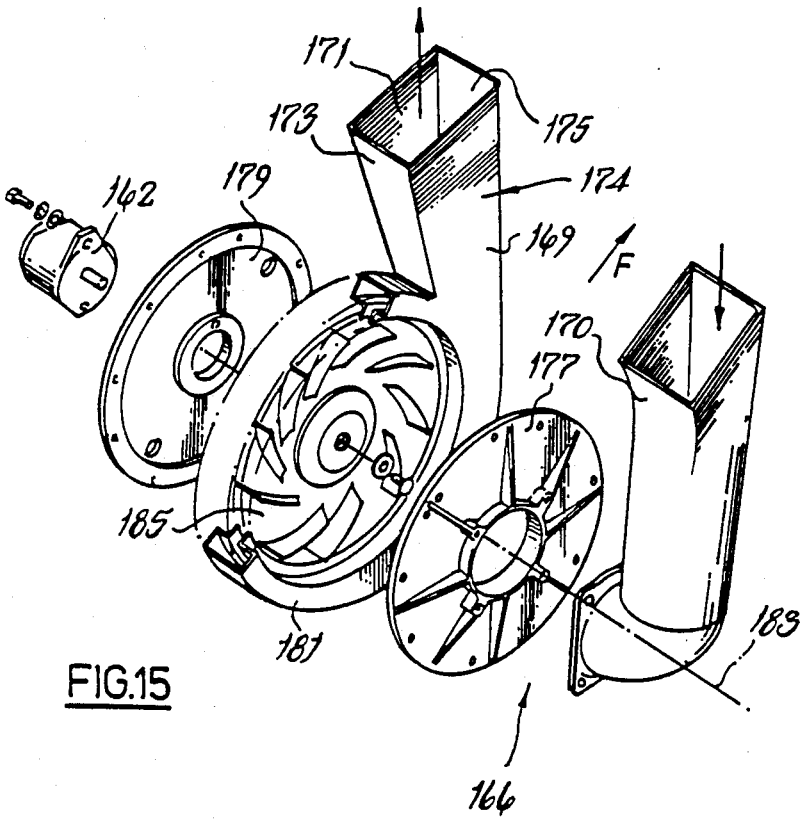
FIG. 15 shows an exploded view of one of the fan assemblies seen in FIG. 14.
Figure 6:
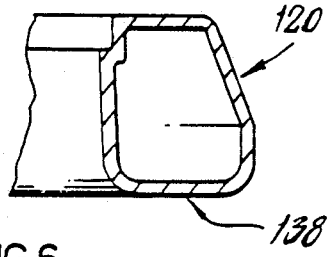
FIGS. 6 and 7 show sections through the nozzle of FIG. 5 as indicated by arrows VI - VI and VII—VII in FIG. 5.
Figure 7:
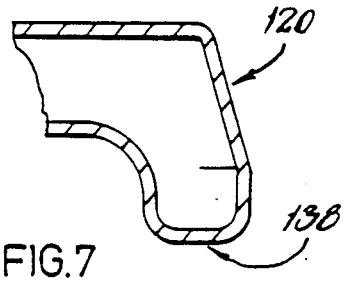
Figure 8:
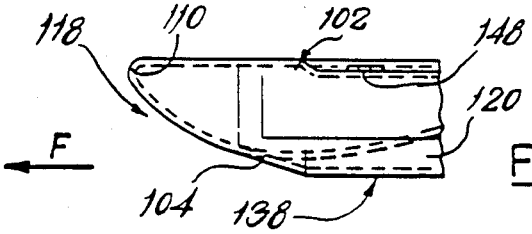
FIG. 8 shows a side elevation view of the nozzle in the direction indicated by arrow VIII in FIG. 5.
Figure 14:
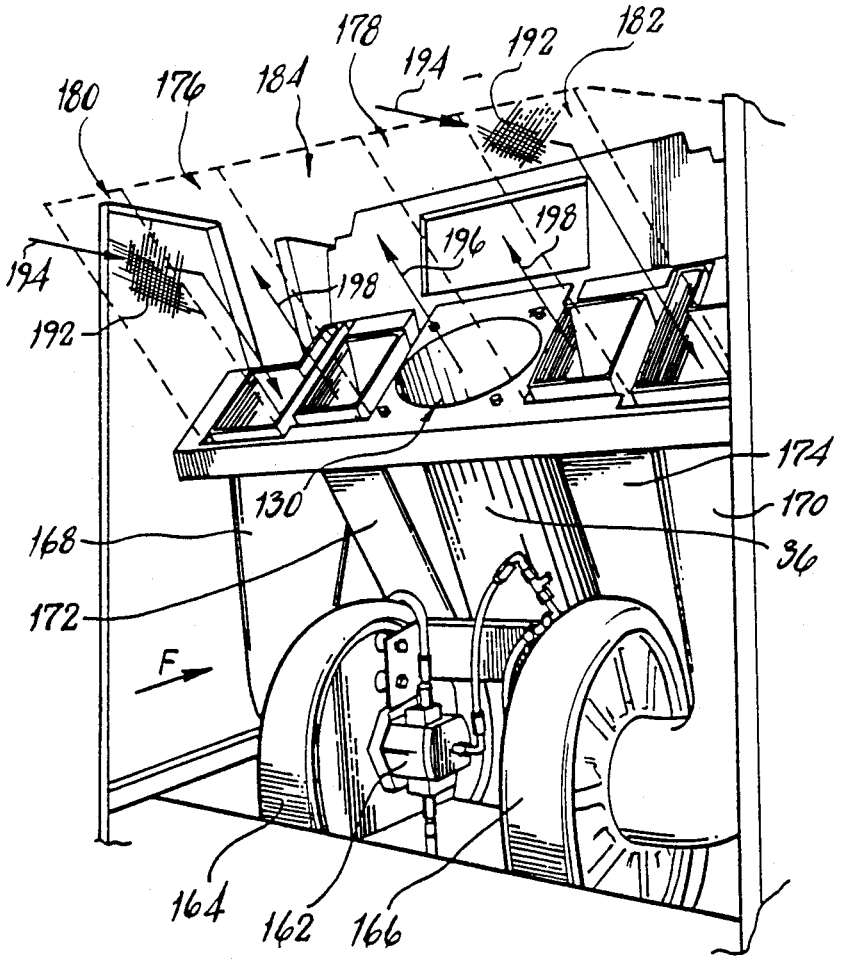
FIG. 14 shows a perspective view of the suction gear including the fan assembly of the vehicle of FIG. 2, the direction of viewing being indicated, approximately by arrow XIV in FIG. 2, this figure also showing, diagrammatically, the positions and approximate dimensions of two plenum chambers, and two vacuum chambers which co-operate with the ducts seen in FIG. 14.

As shown in FIG. 15, fan assembly 166 comprises a bladed impellor 185 rotated by hydraulic motor 162 about a lateral axis 183 within a housing formed by an annular duct 181 blending with diffuser duct 174, together with a rear plate 179 and a front plate 177 having a central inlet opening connected to suction duct 170. FIG. 15 shows the detail of the duct walls. In FIG. 14, these are shown encased in plastic sound absorbent material and are not seen so well. The diffuser duct is quadrilateral in cross-sectional shape and generally rectangular. One or both pairs of the duct walls may diverge. In this embodiment front and rear walls 175, 173 diverge more rapidly than side walls 171, 169. Where one pair of walls diverges and one pair are parallel, the included angle between the diverging walls preferably lies in the range of 5 degrees to 20 degrees, and 10 degrees to 12 degrees being the preferred range, with 11 degrees the optimum angle. Where all four sides are divergent, the included angle between opposite sides may be from 3 degrees to 15 degrees, preferably 5 degrees to 8 degrees and ideally 6 degrees. It will be noted that fans 164 and 166 are positioned at a relatively low location so that the diffuser ducts 172 and 174 have sufficient length for non-turbulent reduction of air velocity. For example, with a fan outlet air velocity of about a 130 kilometers per hour it has been possible to attain a reduction of air velocity to approximately 8 kilometers per hour at the discharge from the plenum chambers, in a distance of about 60 centimeters, in this embodiment. Preferably, a diffuser duct length of at least 30 centimeters is provided.

In use, fans 164, 166 evacuate tank 38 via suction ducts 168, 172 and suction chambers 180, 182 which are closed at their tops 171, 169 and open rearwardly through screens 192 into the tank. The pressure drop in the tank causes air inlet thereto via nozzle 30 and suction duct 36. Entrained matter hits top surface 186 of the tank and is deposited therein. The pressure sides of the fans discharge through diffuser ducts 172, 174 which permit efficient conversion of air kinetic energy to pressure and volume flow energy without turbulence, whereby also the efficiency of conversion of fan energy to air flow energy is significantly enhanced. Efficient deposition of matter within the tank and avoidance of undue dust discharge through the plenum chambers is promoted by use of a water spray from a water tank 167 to a spraynozzle (not shown) in front of nozzle 30 and discharging directly downwards onto the surface to be swept. The water thereby collected in tank 38 is recirculated via a filtering screen, back to the tank. The tank has a lower most portion with adjacently downwardly sloping walls from which portion the recirculated liquid is drawn. The tank includes a separate clean water compartment feeding water to nozzles on the brush gear.

BRUSH GEAR—BRUSH MOUNTING AND CONTROL

In U.S. Pat. No. 4,335,482 ( Jones ) there is disclosed a mounting for a rotary brush of a sweeper vehicle. The brush is mounted on a leading arm. The brush can pivot about an axis extending longitudinally of the arm, and about an axis extending transversely of the arm. Both axes extend through the rotation axis of the brush. Shock absorbing means is provided to reduce bounce of the brush, and to absorb impact loads. Spring means is provided to hold the brush in a defined basic working position. In other proporals various control systems are provided to sense and respond to impacts. Nevertheless, the basic vulnerability of a leading arm brush mounting is retained and is protected only according to the degree of sophistication and responsiveness of the overload and impact-detecting control systems associated with it. However, leading arm brush mountings have considerable advantages with respect to the basic brushing action, but some improvement in the means for protecting such brush mountings from impact and similar loads is needed, which does not lead to the complication and expense of previously proposed sophisticated protection and control systems. Likewise, improved and preferably simplified means for positioning the brush in work and for controlling its attitude in work are desirable.

As shown in the drawings, brush gear 24 comprises brushes 40 and 42 carried on mountings 44, 45 comprising mounting arms 46 and 48 which are pivotally connected to the steered support means 28 at their inner ends for pivotal movement about upwardly extending axes 54, 56. The brush mountings extend generally forwardly with respect to direction F. The brushes rotate about upwardly extending axes in the direction shown to sweep matter laterally inwardly for collection by nozzle 30. The left and right arms each comprise inner and outer portions 200 and 202 respectively, arranged end to end with pivot means 204 having a generally upwardly extending pivot axis 206 interconnecting the portions 200, 202, whereby the outer portion 202 can turn with respect to the inner portion 202 to permit the brush to yield in a rearward direction by folding movement of the brush mounting, upon impact of the brush with an object.

Inner portion 200 of each mounting arm comprises a parallelogram linkage 208 consisting of an upper link 210 and a lower link 212. At their inner ends, these links are directly pivoted to support means 28. At their outer ends, they are likewise directly pivoted to outer arm portion 202. This latter is in the form of an arm and bracket assembly rigidly fastened to the cover 204 of the respective brush 40, 42. Linkage 208 serves to maintain the attitude of outer arm portion 202 whereby the brush attitude can be controlled. The outer portion 202 is held by resilient means in the form of a spring 216 against a stop 218, thereby defining the normal working positions of the arm portions 200, 202 relative to each other. In the normal working position of the brushes with respect to the fore/aft centre line of the nozzle, assuming that the brushes are set for sweeping the normal sweeping width of the machine, the mounting arm inner portions 200 are inclined towards the nozzle centre line at an inclination of about between 5 degrees and 25 degrees. The mounting arm outer portions 202 are located on the outboard side of the inner portions and extend laterally and outwardly therefrom. The associated brush is likewise located mainly on the outboard side; of its inner mounting arm portion. This arrangement, and the geometry of the brush mounting assembly generally, is such that a rearward force acting on the brush due to an impact causes the brush mounting linkage to fold and exert an inwardly-directed force on the inner brush mounting arm portion 200.

In work, spring 216 holds outer arm portion 202 against stop 218. Parallelogram linkage 208 holds outer arm portion 202 at a predetermined attitude. In this embodiment the pivot joints at the opposite ends of upper link 200 are universal joints while those at the ends of lower link 212 are ball joints, whereby the pivotal movement about vertical axes 56, 206 as well as the corresponding transverse axes required by the parallelogram linkage, is permitted. Stop 218 is adjustable to determine one aspect of the working position of brush 42. In addition, the brush is also adjustable about a brush side loading axis 220 defined by a bolt 222, the position being adjusted by means of adjustment bolts 224. Adjustment about axis 220 determines the loading of the brush against the swept surface in its main sweeping region which is located at the periphery of the brush on the side thereof remote from axis 220. A front/rear adjustment axis 224 permits the loading of the brush to be increased forwardly or rearwardly in the prime sweeping zone at the front of the brush. In this embodiment, no provision has been made for adjustment about axis 224, but such can readily be made. Adjustment about both axes 220 and 224 could be readily effected by remote control, for example by means of slave hydraulic rams, and/or springs.

Control of the brush gear will now be described. Each brush is driven by a hydraulic motor so as to rotate in direction R. Once the lateral position of each brush has been set with respect to the front steerable wheels 16, no further lateral adjustment is needed during steering manoeuvres, except when some obstacle is encountered or it is desired to, for example, move one of the brushes outwardly to sweep under an overhanding building structure. Lateral control of each brush is effected by means of inner and outer hydraulic rams 226 and 228. Inner ram 226 constitutes resilient means. It is supplied with a constant low pressure source of hydraulic fluid which biases the parallelogram linkage 208 outwardly. Ram 226 is connected by ball joints 230, 232 at its ends so as to act between support means 28 and lower link 212. By virtue of the geometry of the assembly, ram 226 exerts a light lifting force on the brush, thereby offsetting its weight to an adjustable extent. Outer ram 228 functions as an adjustable stop to limit outward movement of the linkage. In use, when the linkage is to be moved outwards, the driver operates a valve to connect outer ram 228 to tank whereby it can retract under the outward force of inner ram 226 and/or the reaction force of the brush against the road surface. When the brush has reached the desired position, the driver isolates ram 228 and it then acts as a stop and holds the linkage in its new position relative to support means 28. To move the brush to its central transport position or to move it inwards, outer ram 228 is pressurised. During normal work this action defeats the relatively low hydraulic pressure supplied to inner ram 226 and the brush moves inwards in contact with the surface being swept. If the brush is to be raised, inner ram 226 is also pressurised, thereby also raising the linkage as it moves inwards.

When the brush hits an obstacle, it first swings rearwards about axis 206 while generating a laterally inward force on linkage 208 which overcomes the light outward bias from ram 226 and permits the brush also to swing inwards as well as rearwards. A relief or pressure control valve connected to ram 226 may permit it to discharge to tank under these conditions. Alternatively, according to the setting of the relief valve, ram 226 may cause the linkage to rise thereby providing a third mode of relief movement of the brush. At the same time outer ram 228 resiliently resists the lateral inward movement of the linkage by development of a partial vacuum within the ram. Thus, outer ram 228 is mainly a stop device which also functions as a swing actuator and under impact provides resilient resistance. Inner ram 226 functions mainly as a resilient device loading the linkage outwards but which also has lift functions and overload relief functions under impact conditions. Ram 228 acts through ball joints 234 and 236 between support means 28 and upper link 210.

Amongst other modifications which could be made in the above embodiment are alternative resilient devices in place of those provided, alternative pivot joint constructions and attitude adjustment means, and general modifications to the geometry of the assembly. The two single acting rams could be replaced by a single double-acting ram.

BRUSH MOUNTING—BRUSH COVERS

In the case of matter removal means such as brush gear of a cleaning vehicle it is found that the brush heads are vulnerable to damage, particularly in the case of those mounted on leading arms. Usually, these structures carry drives such as hydraulic motors together with spray nozzles, together with the linkage for supporting the brush head. All these structures are vulnerable to damage upon impact with fixed object such as street furniture. Previous proposals for meeting these requirements, such as freely rotatable impact plates, have not been found to be adequate, and improvements are required in respect of reduced vulnerability and/or reducing the height requirements of the brush assembly so that the latter can sweep under certain items of street furniture such as seats and the like.

Figure 2:
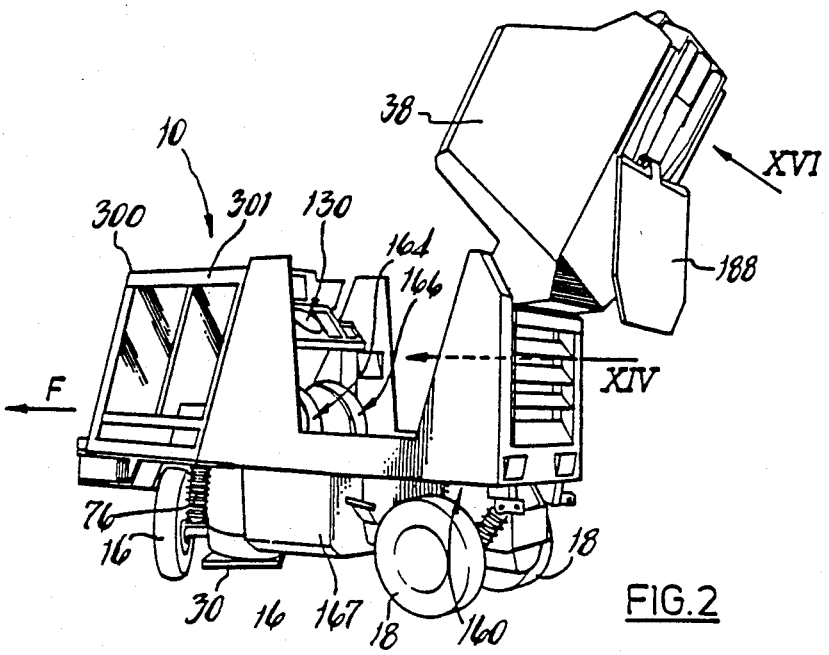
FIG. 2 shows a perspective view of the vehicle of FIG. 1 as seen from the rear and one side, with the vacuum tank shown raised to its rear discharge position for emptying into a skip or the like, the steering gear and nozzle being shown turned for a right hand corner.
Figure 13:
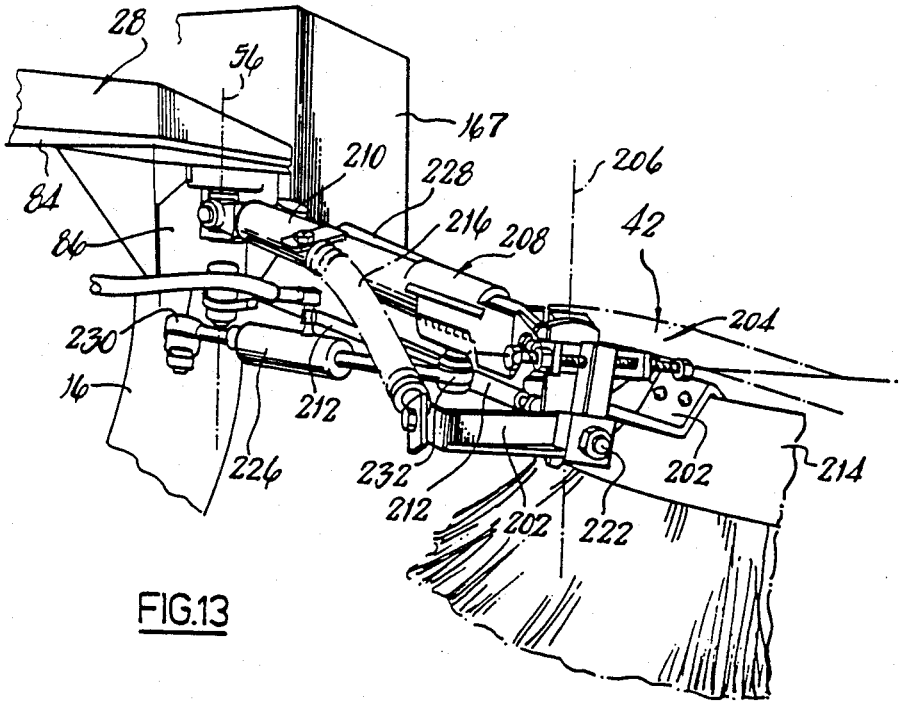
FIGS. 12 and 13 show, on a larger scale, one of the brushes of the vehicle of FIG. 1 and details of its mounting, the direction of viewing in FIG. 12 corresponding approximately to that of FIG. 1, and in FIG. 13 being indicated by arrow XIII in FIG. 12.
Figure 12:
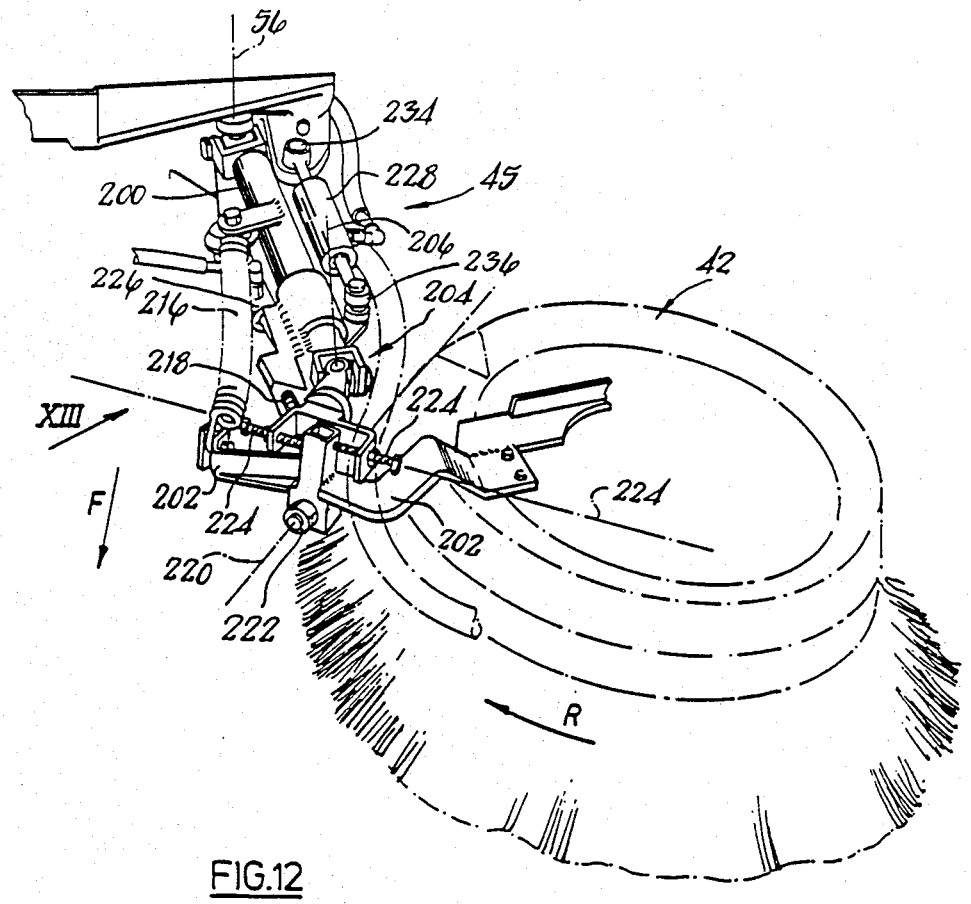

FIG. 23 shows details of brush-supporting covers of FIG. 1. FIGS. 12 and 13 show different brush gear supports. As shown in FIG. 23 brush 42 comprises bristles 250 mounted on a carrier plate 252 coupled to the output shaft 254 of hydraulic motor 256 driven through hose couplings 258 to effect rotation about axis 260. The motor is located in a housing 260 forming a brush cover and serving to house motor 256 together with spray nozzles 262 located at circumferentally spaced positions along the front periphery of housing 260 to spray water in an arc indicated by line 263 on the forward side of the cone described by bristles 250. Nozzles 262 receive water from the clean water compartment of tank 167.

Housing 260 forms part of the mounting structure for brush 42 and is in the form of a hollow body forming part of the load bearing support structure of the brush. The housing has connection means 264 for direct load-bearing connection to the brush mounting linkage. In this embodiment, the outer portion 202 of the brush mounting arm is rigidly secured to connection means 264, and the latter structurally integral with housing 250, which is formed as a single hollow structure of a suitable plastics material, and serves as a flexible and resilient impact device for collisions of the brush assembly with street furniture such as seats and lamp posts. The hollow plastic structure has internal metal support elements 266 which are directly coupled to the brush mounting linkage. These serve to transfer the brush support loads to the hollow plastics body 260. However, the major portion of the strength and rigidity of the housing 260 is derived from its own plastics material and the hollow form thereof. The internal metallic structure 266 may be bonded thereto. Openings may be formed in the hollow body sufficient for admission and removal of the motor 256 and its hoses. It will be noted that the brush mounting arm connected to brush 42 extends generally horizontally thereto, and preferably does not project above same by more than about 2.5 centimetres.

In use, housing 260 serves to protect motor 256 and nozzles 262 from damage by impacts with fixed objects. The housing adds almost nothing to the overall height of the brush assembly and permits connection of the brush mounting linkage directly to it. Its hollow form gives it significant structural strength whereby the plastics material has sufficient rigidity while retaining the inherent impact resistance of such material, whereby the vulnerability of the brush assembly is greatly reduced.

The materials for the construction of housing 260 may be the same synthetic polymers as those for the nozzle 30.

VEHICLE CAB

In conventional cab arrangements for cleaning vehciles, and many other types of vehicles, the general mode of construction is by use of fabrication techniques involving the use of hundreds of different parts each requiring its own manufacturing process. The result is that the cab is relatively complex and expensive, and is thus in need of considerable simplification and cost reduction.

In this embodiment, a driver's cab for a cleaning vehicle has a frame and wall means mounted on the frame. The frame comprises a pair of laterally spaced structural side frames, and the wall means extends laterally between the side frames and comprises at least one integral moulding of plastics material forming at least part of at least two adjacent walls of the cab, such as the floor and the rear wall. The frame comprises a hollow section having at least one and preferably two flanges. A wall portion of the hollow section is disposed at less than 90 degrees with respect to an adjacent wall portion, whereby the obstruction of vision provided by the section in critical vision areas of the cab, such as the front left and right lower side portions, is reduced. The hollow section comprises extruded aluminium. Two structural side frames are linked by cross frame members. The hollow section provides an angled profile to seat a complementary flange of the plastic wall portion of the cab. The frame section is formed by pulltrusion, or any other suitable forming operation. The flanges are disposed generally at right angles to each other. In use, the frame elements are slightly separated and then allowed to snap back into position to hold the cab wall elements in place. By this construction, the number of individual parts for the cab is very greatly reduced. The frame is relatively cheap to produce. The cab wall elements are likewise relatively inexpensive due to production by vacuum forming, or other simple forming techniques such as rotational moulding, blow moulding or the like. The side surfaces of the cab providing the door and windows may be formed from suitable section aluminium extrusions having provision for glass support purposes. A single door may be provided at one side only of the cab, with the other side having a fixed door / wall unit. The door unit may be hinged or arranged to slide for opening purposes. The cab wall elements may be formed in a suitable transparent plastics material such as polycarbonate, whereby visual inspection of the brush gear below the cab can be achieved in use. It is believed that the cab construction may well be suited to many other types of vehicles, including tractors and both off-highway and road vehicles.

Figure 17:
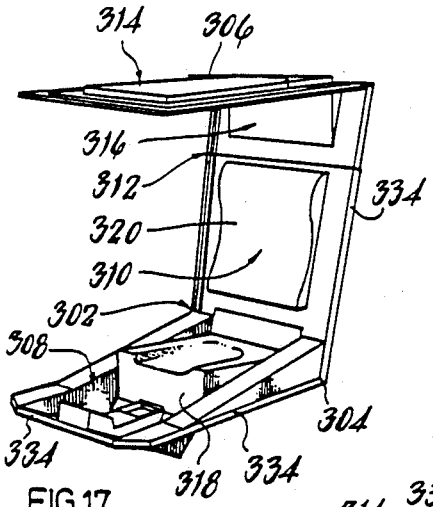
FIG. 17 shows an assembly of two generally L-shaped cab wall elements.

As shown in FIGS. 1, 2 and 17 to 22, cab 300 of vehicle 10 is mounted on the frame 84 of the vehicle through resilient mounts ( not shown ). The cab comprises a frame 301 having mounted thereon wall means 302 in the form of two integral plastic mouldings 304, 306, each forming part of at least two adjacent walls of the cab. Details of the structure of the cab wall means are shown in FIG. 17. Each of the plastic mouldings 304, 306 is generally L-shaped. Moulding 304 provides the base or floor portion 308 of the cab, together with a major part of the rear wall 310. A join line 312 defines the adjacent edges of the two plastic mouldings. Moulding 306 provides the cab roof 314, and the remaining portion 316 of the rear wall. The two wall portions 304 and 306 are rivetted or bonded to the frame 301 in a very straightforward manner, whereby cab construction is greatly simplified. It will be noted that moulding 304 provides a base 318 for the driver's seat. This requires merely the addition of suitable resilient material to constitute an acceptable seat. Likewise, a moulded back rest 320 also merely requires similar resilient material. Alternatively, a conventional vehicle seat may be secured to these structures. Laborious multiple fabrication operations have been greatly reduced, and in fact almost eliminated.

Figure 18:
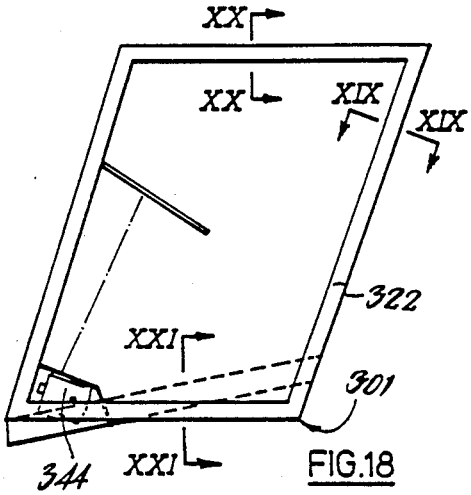
FIG. 18 shows a side elevation view of frame elements of the driver's cab of the vehicle of FIG. 1.
Figure 20:
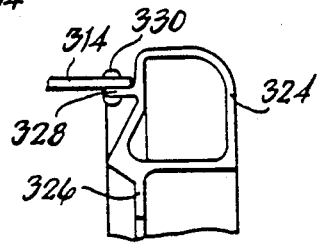
FIGS. 19, 20 and 21 show sections through a side frame of the cab of the vehicle, the sections being taken in the directions indicated by arrows XIX—XIX, XX—XX, and XXI—XXI in FIG. 18.
Figure 19:
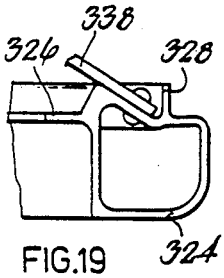
Figure 22:
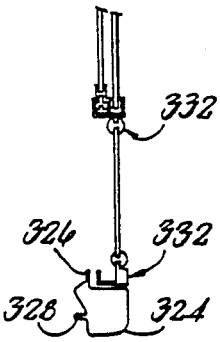
FIG. 22 shows the section of FIG. 21 on a smaller scale together with an associated sliding window assembly.
Figure 21:
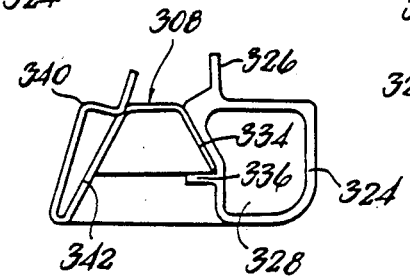

Referring now to FIGS. 18 to 22 showing details of the cab frame arrangement, two integral side frame members 322 are provided. Each is formed as a welded assembly of an extruded aluminium section seen in FIGS. 19 to 22. The aluminium section 324 has flanges 326 and 328 disposed as shown. Flange 328 provides a support for the cab roof 314, which is secured by rivets 330. Suitable resilient sealing strips ( not shown ) are provided on the flanges 326, 328 to ensure water tight joints. Flange 326 lies in a generally vertical plane all round the side frame members and serves to support the cab window assembly designated in general by reference numeral 332. The floor 308 of the cab is formed with a sloping side flange 334 at its edges. Similar flanges are formed on the cab back wall portions. These flanges co-operate with a profiled wall portion 336 of the hollow section 324, as shown in FIG. 21. The flange 328 serves as a retaining stop. The same wall portion 336 co-operates with a corresponding flange 338 of a polycarbonate rear view window portion seen in FIGS. 19 and 14, but not indicated in FIG. 17. Frame 301 comprises cross members to provide lateral stiffening, these including the section 340 seen in FIG. 22 and having a flange 342 to co-operate with the flange 334 at the front edge of the cab base wall 308. Similar transverse stiffeners are provided at each corner of the cab. FIG. 18 shows the positions in the cab of the steering gear box 344 and a driver's control panel 346. The absence of any undercuts in the moulded plastic assemblies 304, 306 enables these to be produced relatively rapidly and economically by vacuum forming techniques.

I claim:

1. A cleaning vehicle comprising a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising a brush and a matter inlet suction nozzle;

said brush being pivotally mounted on said vehicle body for lateral movement inwards and outwards relative to the travel direction of the vehicle about an axis relative to the adjacent structure of said vehicle body during said use; and in addition to said pivotal mounting of said brush on said vehicle body, support means for said brush and for said matter inlet nozzle permitting additional pivotal movement of said brush and permitting pivotal movement of said inlet nozzle relative to the adjacent structure of said vehicle body, the axes of said pivotal movement and of said additional pivotal movement of said brush being spaced apart, and said control means to control said steerable wheels being directly connected to both said brush and to said inlet nozzle to effect said additional pivotal movement of said brush and said pivotal movement of said inlet nozzle relative to the adjacent structure of said vehicle body and in synchronism with and in the same sense as the steering movement of said steerable wheels.

2. A cleaning vehicle according to claim 1 further characterized in that said ground wheels include at least one driven wheel whereby said vehicle is self-propelled, a prime mover being provided to drive said driven wheel, and said matter removal means comprising suction gear including a chamber to receive matter removed in a cleaning operation, said matter inlet nozzle being positionable in close proximity to said surface to be cleaned to remove matter therefrom, a duct connecting said chamber and said matter inlet nozzle, and suction means being in communication with said chamber to draw air and matter through said matter inlet nozzle and through said duct into said chamber, said support means comprising structure mounted on said vehicle body for pivotal movement about an upwardly extending axis relative thereto and connected to said steerable wheels for steering movement in synchronism with and in the same sense as said steerable wheels.

3. A cleaning vehicle according to claim 1 further characterized in that a further brush is similarly mounted to effect said additional pivotal movement in synchronism with said one brush, and said matter inlet nozzle is positioned to receive matter swept inwards by contra-rotation of the brushes, and said matter inlet nozzle is maintained in proper relationship to both said brushes through said pivotal movement and under the control of said control means.

4. A cleaning vehicle according to claim 1 further characterized in that said brush and at least one of said steerable wheels are mounted on said support means.

5. A cleaning vehicle according to claim 4 further characterized in that said support means comprises a frame carrying both said steerable wheels and mounted for pivotal movement about an axis located between said steerable wheels.

6. A cleaning vehicle according to claim 5 further characterized by a duct connected to said matter inlet nozzle to supply suction thereto, said duct extending generally upwardly from said matter inlet nozzle and being located close to the axis about which said support frame turns.

7. A cleaning vehicle comprising:

a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising a brush and a matter inlet suction nozzle positionable in close proximity to the surface to be cleaned;

said brush being pivotally mounted on said vehicle body for lateral movement inwards and outwards relative to the travel direction of the vehicle about an axis relative to the adjacent structure of said vehicle body during said use;

a chamber carried by said vehicle body to receive matter removed by said matter removal means in a cleaning operation;

a duct connecting said chamber with said inlet nozzle; and suction means in communication with said chamber to draw air and matter through said matter inlet nozzle and through said duct and into said chamber;

said matter inlet nozzle having a smooth internal profile and said nozzle including as a structural part thereof a moulding made of a polymeric material and in the form of a hollow chamber, the lower surface of which moulding provides part of said smooth internal profile;

said hollow chamber being disposed so that said lower surface of said moulding directly overlies the surface being swept during use; and said lower surface of said moulding having a convex profile which, as seen in cross-section taken in the travel direction, smoothly merges with a curved lower portion of said duct.

8. A cleaning vehicle comprising:

a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising a brush and a matter inlet suction nozzle positionable in close proximity to the surface to be cleaned;

said brush being pivotally mounted on said vehicle body for lateral movement inwards and outwards relative to the travel direction of the vehicle about an axis relative to the adjacent structure of said vehicle body during said use;

a chamber carried by said vehicle body to receive matter removed by said matter removal means in a cleaning operation;

a duct connecting said chamber with said inlet nozzle; and suction means in communication with said chamber to draw air and matter through the matter inlet nozzle and through said duct and into said chamber;

the front portion of said inlet nozzle being generally convex as seen in plan view so that the air path under said front edge of said inlet nozzle to the rear region of the latter which connects same to said duct is of approximately equal length across the full operating width of the inlet nozzle;

the forward portion of said inlet nozzle which directly overlies the surface being swept, and which has a smoothly profiled downwardly facing convex lower air guide surface, extends lengthwise of the inlet nozzle in the travel direction throughout a substantial portion of the overall dimension of the inlet nozzle measured in said travel direction, and throughout its lengthwise extent overlies directly the surface being swept and defines therewith a forwardly facing and rearwardly tapering throat in which matter is entrained in the air flow.

9. A cleaning vehicle according to claim 8 characterized in that said matter inlet nozzle has a smooth internal profile with rounded contours, and said duct connecting said chamber to said matter inlet nozzle extends upwardly from said matter inlet nozzle which is adjacent said surface to be cleaned to a discharge location in said chamber, the cross-sectional profile of said duct smoothly merging with that of said matter inlet nozzle, and said duct being of not-circular cross-sectional profile throughout a substantial portion of its length up to and including its discharge end, the duct being generally rounded in profile and having major and minor axes, the major axis extending generally transverse to the direction of normal forward motion of said vehicle.

10. A cleaning vehicle according to claim 9 characterized in that said duct comprises an outwardly flared portion at its discharge end.

11. A cleaning vehicle comprising:

a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising a brush and a matter inlet suction nozzle;

said brush being pivotally mounted on said vehicle body for lateral movement inwards and outward relative to the travel direction of the vehicle about an axis relative to the adjacent structure of said vehicle body during said use; and said brush being rotatable about an upwardly extending rotational axis and carried on a brush mounting arm assembly extending generally forwardly with respect to the normal direction of operative forward motion of said vehicle, to sweep matter laterally with respect to said direction, said brush mounting arm assembly comprising inner and outer arm portions connected by pivot means having a generally upwardly extending pivot axis interconnecting said portions, the relative dispositions of said brush mounting arm portions with respect to the travel direction in their normal in-use positions being such that said inner brush mounting arm portion normally extends generally forwardly with respect to the travel direction and said outer brush mounting arm portion extends generally laterally outwardly therefrom with respect to the center line of the vehicle, whereby on impact of said brush with a foreign body, the outer brush mounting arm portion can pivot with respect to said inner arm portion to permit the brush to yield in a rearward direction by folding movement of the brush mounting arm assembly.

12. A cleaning vehicle according to claim 11 characterized in that said inner brush mounting arm portion comprises upper and lower links forming a parallelogram linkage, and said pivot means connecting said inner and outer brush mounting arm portions permits pivotal movement of said outer brush mounting arm portion about said upwardly extending pivot axis until it engages a stop defining the normal working attitude of the outer brush mounting arm portion with respect to the inner brush mounting arm portion, and resilient means being provided to hold the brush in said normal working position.

13. A cleaning vehicle according to claim 12 characterized in that said brush is also position-adjustable about at least one further axis, said further axis lying in a generally horizontal plane.

14. A cleaning vehicle according to claim 12 characterized in that said brush is position-adjustable about two further axes lying in a generally horizontal plane, one axis extending generally in the travel direction, and the other axis extending generally laterally with respect thereto.

15. A cleaning vehicle comprising:

a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising brush gear and a matter inlet suction;

said brush gear being carried by said vehicle body and comprising a brush rotatable about an upwardly extending axis and carried on a brush mounting extending generally forwardly with respect to the normal direction of operative forward motion of said vehicle to sweep matter laterally with respect to said direction;

said brush mounting being connected to said vehicle body for pivotal movement about a generally upwardly extending axis for lateral movement towards and away from a center line of the vehicle;

actuating means connected to said brush mounting and acting to bias said mounting outwards with respect to said center line and towards a working position of said brush;

adjustable stop means under remote control from a driver of said vehicle, the stop means being connected to said mounting to define a position at which said mounting stops in said outward movement; and actuating means under driver control to return said mounting towards said vehicle center line.

16. A cleaning vehicle according to claim 15 characterized in that said adjustable stop means and said actuating means under driver control to return said mounting towards the vehicle center line are provided by a pressure operated ram.

17. A cleaning vehicle according to claim 15 characterized in that a portion of a driver's cab of said vehicle is provided with transparent material whereby visual inspection of the position of said brush gear below the cab during use can be achieved for the purpose of manually setting said stop means.

18. A cleaning vehicle according to claim 15 characterized in that said actuating means connected to said brush mounting comprises a pressure operated ram connected to a control circuit which normally provides the ram with a pressure supply sufficient to achieve outward movement of said brush mounting, said control circuit permitting pressure relief under conditions of overload such as an impact of the brush gear with an obstacle.

19. A cleaning vehicle comprising:

a rigid self-propelling vehicle body:

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising brush gear and a matter inlet suction nozzle;

said brush gear being pivotally mounted on said vehicle body for lateral movement inwards and outwards relative to the travel direction of the vehicle about an axis relative to the adjacent structure of said vehicle body during use;

a chamber carried by said vehicle body to receive matter removed by said matter removal means in a cleaning operation;

a duct connecting said chamber with said inlet nozzle; and suction means having its suction side connected to said chamber through screening means to draw air from said chamber thereby lowering the pressure therein and causing air and matter to be drawn through said inlet nozzle and through said duct and into said chamber where the matter is deposited;

the pressure side of said suction means discharging screened air drawn from said chamber through said screening means to a diffuser duct have duct walls which diverge towards the outlet end thereof, for discharge to atmosphere;

the length of said diffuser duct being at least thirty centimeters, the duct being of rectangular cross-sectional shape, all four walls of the duct diverging and the included angle between opposite sides of the duct being from three degrees to fifteen degrees.

20. A cleaning vehicle comprising:

a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising brush gear and a matter inlet suction nozzle;

said brush gear being pivotally mounted on said vehicle body for lateral movement inwards and outwards relative to the travel direction of the vehicle about an axis relative to the adjacent structure of said vehicle body during use;

a chamber carried by said vehicle body to receive matter removed by said matter removal means in a cleaning operation;

a duct connecting said chamber with said inlet nozzle and suction means having its suction side connected to said chamber through screening means to draw air from said chamber thereby lowering the pressure therein and causing air and matter to be drawn through said inlet nozzle and through said duct and into said chamber where the matter is deposited;

the pressure side of said suction means discharging screened air drawn from said chamber through said screening means to a diffuser duct having duct walls which diverge towards the outlet and thereof, for discharge to atmosphere;

the length of said diffuser duct being at least thirty centimeters and the duct being of rectangular cross-sectional shape, two walls thereof diverging and the included angle between said diverging sides being from five degrees to twenty degrees.

21. A cleaning vehicle comprising:

a rigid self-propelled vehicle body;

ground wheels to support said vehicle body and including one or more steerable wheels mounted for steering movement relative to the adjacent structure of said vehicle body;

control means to control said steerable wheels;

matter removal means positionable in working relation to a surface to be cleaned to remove matter therefrom, said matter removal means comprising a brush and a matter inlet suction nozzle;

said brush being pivotally connected by at least one mounting arm to said vehicle body for lateral movement inwards and outwards relative to the travel direction of the vehicle about an axis relative to the adjacent structure of said vehicle body during use; and connecting means for connecting said brush to said mounting arm, which connecting means includes a hollow body forming part of the load bearing support structure for said brush and serving as a housing for the drive means therefore, said hollow body having connection means for direct load-bearing connection to said mounting arm and being formed as a single hollow structure made of a polymeric material and serving as a flexible and/or resilient impact device for collisions with street furniture and the like.

* * * * *